US010178471B2

(12) United States Patent
Yoshino

(10) Patent No.: US 10,178,471 B2
(45) Date of Patent: Jan. 8, 2019

(54) UNIDIRECTIONAL CONDENSER MICROPHONE UNIT

(71) Applicant: AUDIO-TECHNICA CORPORATION, Machida-shi, Tokyo (JP)

(72) Inventor: Satoshi Yoshino, Machida (JP)

(73) Assignee: AUDIO-TECHNICA CORPORATION, Machida-Shi, Tokyo (JP)

( * ) Notice: Subject to any disclaimer, the term of this patent is extended or adjusted under 35 U.S.C. 154(b) by 0 days.

(21) Appl. No.: 15/674,070

(22) Filed: Aug. 10, 2017

(65) Prior Publication Data

US 2018/0054673 A1 Feb. 22, 2018

(30) Foreign Application Priority Data

Aug. 22, 2016 (JP) ..... 2016-161773

(51) Int. Cl.

| | |
|---|---|
| ***H04R 25/00*** | (2006.01) |
| ***H04R 1/32*** | (2006.01) |
| ***H04R 1/22*** | (2006.01) |
| ***H04R 19/04*** | (2006.01) |
| ***H04R 21/02*** | (2006.01) |

(52) U.S. Cl.

CPC ..... *H04R 1/326* (2013.01); *H04R 1/22* (2013.01); *H04R 19/04* (2013.01); *H04R 21/02* (2013.01)

(58) Field of Classification Search

CPC ..... H04R 1/326; H04R 1/222; H04R 19/04; H04R 21/02

USPC ..... 381/356

See application file for complete search history.

(56) References Cited

U.S. PATENT DOCUMENTS

| | | | | |
|---|---|---|---|---|
| 3,864,531 | A * | 2/1975 | Watson | H04R 19/04 381/111 |
| 8,194,895 | B2 * | 6/2012 | Akino | H04R 1/04 381/111 |
| 8,938,085 | B2 * | 1/2015 | Matsui | H04R 1/342 381/355 |
| 9,648,426 | B2 * | 5/2017 | Akino | H04R 19/04 |

(Continued)

FOREIGN PATENT DOCUMENTS

| | | |
|---|---|---|
| JP | H06-046158 Y2 | 11/1994 |
| JP | H07-143595 A | 6/1995 |

(Continued)

*Primary Examiner* — Phylesha Dabney
(74) *Attorney, Agent, or Firm* — Manabu Kanesaka

(57) ABSTRACT

A unidirectional condenser microphone unit includes a unit case that includes a diaphragm that vibrates upon receiving a sound wave, a fixed electrode disposed to face the diaphragm, an insulating base that supports the fixed electrode to form a back air chamber between the insulating base and the fixed electrode and a fixed electrode leading terminal made of metal that is attached to the insulating base, and that leads a signal voltage generated at the fixed electrode, wherein the unit case is provided with a front acoustic terminal hole formed in a front side of the diaphragm and a rear acoustic terminal hole for communication with the back air chamber, wherein the unit case has a second air chamber different from the back air chamber and the fixed electrode leading terminal is provided with a communication path between the back air chamber and the second air chamber.

8 Claims, 8 Drawing Sheets

(56) References Cited

U.S. PATENT DOCUMENTS

| | | | | |
|---|---|---|---|---|
| 2011/0142265 | A1* | 6/2011 | Akino | H04R 1/38<br>381/174 |
| 2013/0004009 | A1* | 1/2013 | Matsui | H04R 1/342<br>381/356 |
| 2015/0189417 | A1* | 7/2015 | Akino | H04R 19/04<br>381/356 |

FOREIGN PATENT DOCUMENTS

| | | | |
|---|---|---|---|
| JP | 2010-136044 | A | 6/2010 |
| JP | 2011-055062 | A | 3/2011 |

* cited by examiner

UNIDIRECTIONAL CONDENSER MICROPHONE UNIT

RELATED APPLICATIONS

The present application is based on, and claims priority from, Japanese Application No. JP2016-161773 filed Aug. 22, 2016, the disclosure of which is hereby incorporated by reference herein in its entirety.

BACKGROUND OF THE INVENTION

Field of the Invention

The present invention relates to a unidirectional condenser microphone unit that allows to improve low-frequency response by downsizing and reduce deterioration in low-frequency directivity due to proximity effect.

Description of the Related Art

A unidirectional microphone has openings provided in the front and the rear of a unit, that is, in a front side and a back side of a diaphragm, the openings being provided for taking in sound waves. With the configuration, a front acoustic terminal is formed in the front of the unit and a rear acoustic terminal is formed in the rear of the unit, and the diaphragm is driven by a difference in sound pressure applied to the front and rear acoustic terminals.

Note that the acoustic terminal refers to a position of air where the sound pressure is affected to the microphone unit, and can be said to be a center position of the air moved simultaneously with the diaphragm provided in the microphone unit. Therefore, in a case of a unidirectional condenser microphone unit, the acoustic terminals exist near the openings (acoustic terminal holes) in the front side and the back side of the diaphragm, as described above.

The above-described unidirectional condenser microphone has a technical problem of deterioration in low-frequency directivity due to proximity effect by a bi-directional component entering the rear acoustic terminal.

FIG. 11 illustrates an example of the proximity effect, and illustrates frequency response characteristics of a conventional typical unidirectional condenser microphone. That is, the horizontal axis represents frequency and the vertical axis represents an output level (in dBV). Then, a characteristic curve A indicates characteristics of a case where a sound wave arrives at 0 degrees, that is, from the front, with respect to a sound collecting axis. A characteristic curve B indicates characteristics of a case where the sound wave arrives at 90 degrees, that is, from the side, with respect to the sound collecting axis. A characteristic curve C indicates characteristics of a case where the sound wave arrives at 180 degrees, that is, from the rear, with respect to the sound collecting axis.

As can be understood from FIG. 11, the characteristic curve B (90 degrees) and the characteristic curve C (180 degrees) intersect in a low-frequency range, and the characteristic curve C (180 degrees) comes close to the characteristic curve A (0 degrees) in a lower-frequency range. This indicates deterioration in the low frequency directivity due to the proximity effect, and one solution to improve the low-frequency response is to prevent the proximity effect from occurring.

In this case, in the unidirectional condenser microphone, if the directivity in the low-frequency range is slightly adjusted to non-directivity side, decrease in the characteristics in the low-frequency range can be compensated.

Therefore, in the conventional unidirectional condenser microphone, a structure has been proposed as first means to improve the low-frequency response, in which two unidirectional condenser microphone units are disposed back to back in a front and back direction and are acoustically coupled. This structure is disclosed in Patent Literature 1: Japanese Unexamined Patent Application Publication No. H07-143595 and Patent Literature 2: Japanese Unexamined Patent Application Publication No. 2011-55062 A.

In the condenser microphone disclosed in the Patent Literature 1 and 2, directivity including the low frequency range can be adjusted by controlling polarization voltages respectively applied to the two condenser microphone units.

In the condenser microphone having the structure, however, front and back acoustic terminals are respectively formed right in front of the diaphragms of the two units disposed back to back in the front and back direction. Accordingly, the distance between the front and back acoustic terminals becomes double of one microphone unit, inevitably resulting in an increase in entire size of the microphone unit.

Further, in the unidirectional condenser microphone, a structure has been proposed as second means to improve the low-frequency response, in which a second air chamber is brought to communicate with a back air chamber of a microphone unit through an acoustic resistor. This structure is disclosed in Patent Literature 3: Japanese Unexamined Patent Application Publication No. 2010-136044 A and Patent Literature 4: Japanese Utility Model Registration H06-046158.

FIG. 8 illustrates a basic configuration of the microphone unit disclosed in the Patent Literature 4. A microphone unit 20 includes a cylindrical unit case 2 that includes a plurality of openings 3 serving as front acoustic terminal holes in its front surface and a plurality of openings 4 serving as rear acoustic terminal holes on a side surface.

Then, a diaphragm 6 and a fixed electrode 7 facing each other are supported by an insulating base 8 disposed on a back side of the fixed electrode 7, and a back air chamber 8*b* is formed between the fixed electrode 7 and the insulating base 8, in the unit case 2. Further, the back air chamber 8*b* communicates with the opening 4 that functions as the rear acoustic terminal holes, through a communication hole 8*c* formed in the insulating base 8 and a first acoustic resistor 13. Further, the back air chamber 8*b* communicates with a second air chamber 16 through a through-hole 8*e* formed in the insulating base 8 in an axial direction and a second acoustic resistor 18.

The second acoustic resistor 18 is constructed to vary its acoustic resistance value upon receiving pressure of an adjustment ring 17 screwed with a fixed electrode leading terminal 9 made of metal which is a metal terminal for taking out an electric voltage from the fixed electrode. The low-frequency response in the unidirectional condenser microphone unit 20 can accordingly be set to be in a proper state by adjusting the acoustic resistance value of the second acoustic resistor 18 by a rotating operation of the adjustment ring 17.

FIG. 9 illustrates an acoustic equivalent circuit of the condenser microphone unit 20 illustrated in FIG. 8, and elements constituting the equivalent circuit can be defined as follows:

P1: sound pressure of a sound wave from the front acoustic terminal (openings 3);

P2: sound pressure of a sound wave from the rear acoustic terminal (openings 4);

m0: mass of the diaphragm 6;

s0: stiffness of the diaphragm 6;

r0: front-side acoustic resistance of the diaphragm 6 r1: acoustic resistance of the first acoustic resistor 13;

s1: stiffness of the back air chamber 8*b;* r2: acoustic resistance of the second acoustic resistor 18; and s2: stiffness of the second air chamber 16.

In the equivalent circuit illustrated in FIG. 9, r2 and s2 are added, as compared with an equivalent circuit of a typical unidirectional condenser microphone.

That is, the equivalent circuit illustrated in FIG. 9 is different from an equivalent circuit of the typical unidirectional condenser microphone in that a series circuit of the acoustic resistance r2 of the acoustic resistor 18 between the back air chamber 8*b* and the second air chamber 16, and the stiffness s2 of the second air chamber 16 is added in parallel to the stiffness s1 of the back air chamber 8*b*.

Frequency response of the unidirectional condenser microphone illustrated in FIGS. 8 and 9, to which the acoustic resistance r2 and the stiffness s2 are added, are exemplarily illustrated in FIG. 10. Note that the frequency response illustrated in FIG. 10 are similar to the example illustrated in FIG. 11, and characteristics A to C indicate characteristics of respective angles relative to the sound collecting axis being 0 degrees, 90 degrees, and 180 degrees.

SUMMARY OF THE INVENTION

In the condenser microphone unit 20, shown in FIG. 8, in which the second air chamber 16 communicates with the back air chamber 8*b* of the condenser microphone unit through the acoustic resistor (second acoustic resistor 18), a non-directional component on the second air chamber 16 is also added to a low-frequency component that is applied to the back side of the diaphragm 6, in addition to a bi-directional component from the rear acoustic terminal hole 4. This causes to increase a ratio of the non-directional component to the bi-directional component, and allows to control the directivity in the low frequency closer to non-directivity.

As shown in FIG. 10, an improvement of the decrease in the low-frequency directivity due to the proximity effect is recognized, as compared with the characteristics shown in FIG. 11.

However, according to the condenser microphone shown in FIG. 8, if the volume of the second air chamber 16 is made small to a certain volume or less, a resonant frequency of the non-directional component of the second air chamber 16 becomes high, and a problem of affecting the frequency characteristics of an intermediate frequency of about 1 KHz arises. For the reasons above, the unidirectional condenser microphones disclosed in Patent Literature 3 and 4 need to keep the volume of the second air chamber to some extent, resulting in an increase in size of the entire microphone unit.

A major objective of the present invention is to provide a unidirectional condenser microphone unit that can be downsized and improve the low-frequency response, and reduce a decrease in the low-frequency directivity due to the proximity effect.

A unidirectional condenser microphone unit according to the present invention includes a unit case in which a diaphragm that vibrates upon receiving a sound wave, a fixed electrode disposed to face the diaphragm, an insulating base that supports the fixed electrode and form a back air chamber between the insulating base and the fixed electrode and a metal terminal attached to the insulating base for taking out a signal voltage generated at the fixed electrode are included, wherein the unit case includes a front acoustic terminal hole is formed in front side of the diaphragm, and a rear acoustic terminal hole to communicate with the back air chamber, wherein a second air chamber different from the back air chamber is provided in the unit case; a communication path communicating the back air chamber and the second air chamber with each other is formed in the terminal for taking out the signal from the fixed electrode.

In this case, in a favorable embodiment, employed is a configuration in which the fixed electrode leading terminal is formed into a pillar shape, and has a shaft hole or a groove hole provided along the axial direction, and the shaft hole or the groove hole constitutes the communication path for communication between the back air chamber and the second air chamber.

Further, in another favorable embodiment, employed is a configuration in which the fixed electrode leading terminal is formed into a columnar shape, and has a spiral groove hole provided on the columnar surface, and the spiral groove hole constitutes the communication path for communication between the back air chamber and the second air chamber.

Then, a configuration can be employed in which a plurality of communication paths for communication between the back air chamber and the second air chamber is formed in the fixed electrode leading terminal.

In addition, a first acoustic resistor is favorably disposed between the back air chamber and the rear acoustic terminal hole, and a second acoustic resistor is favorably disposed between the back air chamber and the second air chamber. Then, a configuration is favorable in which the second acoustic resistor is formed into a toroidal shape and is attached to the fixed electrode leading terminal by insertion of the fixed electrode leading terminal into a central hole, and the second acoustic resistor is formed between an adjustment ring screwed with the fixed electrode leading terminal and the insulating base to make an acoustic resistance value variable.

In addition, the second air chamber is opposing to the back air chamber with the insulating base therebetween and is disposed in the side of the fixed electrode leading terminal.

According to the unidirectional condenser microphone unit having the above configuration, the communication path that allows communication between the back air chamber of the fixed electrode and the second air chamber is formed by utilizing the metal fixed electrode leading terminal through which the signal voltage generated across the fixed electrode and the diaphragm is taken out.

This communication path is formed of the shaft hole or the groove hole provided along the axial direction of the fixed electrode leading terminal, or formed of the spiral groove hole provided on the columnar surface.

As described above, the communication path provided in the fixed electrode leading terminal made of metal can be precisely processed to have a smaller diameter than the through-hole formed in the axial direction in the insulating base made of resin illustrated in FIG. 8, and the communication path, lying between the back air chamber and the second air chamber, effectively act as an acoustic mass (inertance).

A low-pass filter formed of the acoustic mass and stiffness of the second air chamber can consequently lower its cutoff frequency, and, a frequency (resonance point) of a low-frequency component that enters the second air chamber is lowered. As a result, a condenser microphone unit having an improved low-frequency response can be provided without affecting intermediate-frequency response.

DESCRIPTION OF THE PREFERRED EMBODIMENTS

Figure 1:
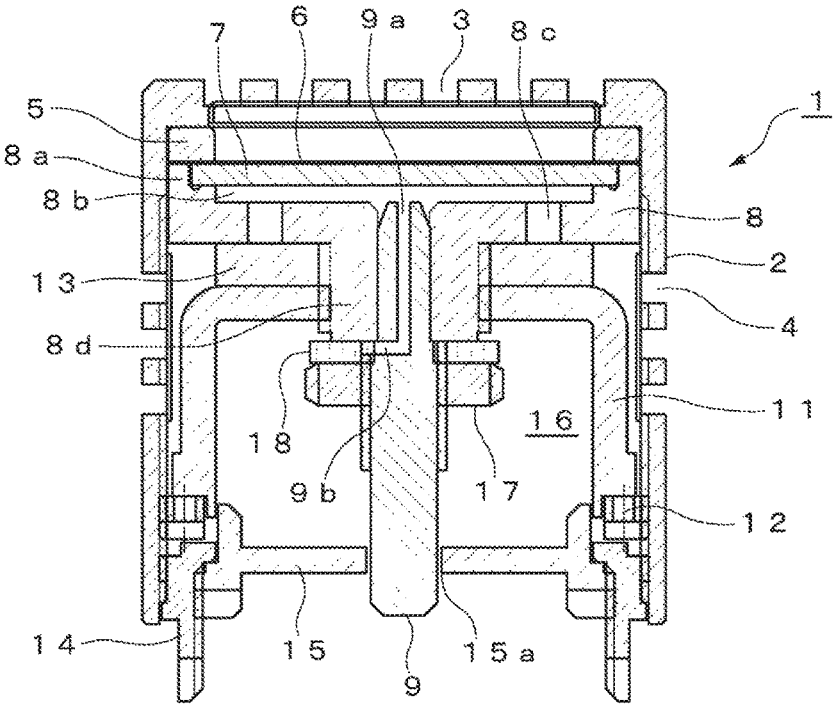
FIG. 1 is a central sectional view illustrating a first embodiment of a condenser microphone unit according to the present invention.

A unidirectional condenser microphone unit according to the present invention will be described on the basis of embodiments illustrated in the drawings.

FIG. 1 illustrates a first embodiment. A condenser microphone unit 1 includes a cylindrical unit case 2 including a plurality of openings 3 in a front side. Further, a plurality of openings 4 is also provided on side surface of the unit case 2. The front openings 3 are front acoustic terminal holes and the side openings 4 are rear acoustic terminal holes.

Further, a diaphragm 6, a periphery of which is attached to a support ring 5, is disposed on a front side in the unit case 2, and a fixed electrode 7 is disposed to face a back of the diaphragm 6 through a small gap. The diaphragm 6 and the fixed electrode 7 face each other with a ring-like spacer although not illustrated in FIG. 1. With the configuration, a capacitor is formed between the fixed electrode 7 and an electrode film (not shown) formed on the diaphragm 6. Then, in the present embodiment, a dielectric film is formed on the fixed electrode 7, and a back electret-type electret condenser microphone unit is formed.

An insulating base 8 formed of resin material is disposed on the back of the fixed electrode 7. A peripheral edge of the insulating base 8 rises toward the front side of the unit case 2, and a periphery of the fixed electrode 7 is fit in this rising portion 8*a*, and the rising portion presses the fixed electrode 7 toward the front side of the unit case 2. Then, a space is formed between the back of the fixed electrode 7 and the insulating base 8 to form a back air chamber 8*b*. Further, a plurality of communication holes 8*c* for communication between the back air chamber 8*b* and the rear acoustic terminal holes 4 of the unit case 2, is formed in the insulating base 8 along a circumference.

As is known, openings with a small diameter (not shown) are provided in the entire surface of the fixed electrode 7.

Further, a cylindrical portion 8*d* is erected in a central portion of the insulating base 8 toward the back side of the insulating base 8. Then, a tip end portion of a rod-like fixed electrode leading terminal 9 formed of metal material is fitted and fixed to inside of the cylindrical portion 8*d*. A lead wire is connected between the fixed electrode leading terminal 9 and the fixed electrode 7, and the fixed electrode leading terminal 9 operates to supply a signal voltage generated at the fixed electrode 7 to an impedance conversion circuit (not shown) using a field effect transistor and the like mounted in the condenser microphone unit 1.

A cup member 11 is accommodated in a state where a bottom opening is fitted into the cylindrical portion 8*d* of the insulating base 8, and the cup member 11 is attached inside the unit case 2 with an opening edge pressed by a ring member 12. That is, a female screw is threaded on an inner peripheral surface of the unit case 2 along a periphery, and the ring member 12 is screwed with the inner peripheral surface of the unit case 2, whereby the cup member 11 is attached in the unit case 2.

A first acoustic resistor 13 formed into a toroidal shape is disposed between a lower bottom surface of the cup member 11 and the insulating base 8 to block the communication holes 8*c* formed in the insulating base 8.

The cup member 11 can be moved in an axial direction according to the degree of screwing of the ring member 12 relative to the unit case 2, thereby to control the apparent density of the first acoustic resistor 13. With this means, a bi-directional component applied through the rear acoustic terminal holes 4 to the back air chamber 8*b* can be adjusted.

Meanwhile, a shaft hole 9*a*, which reaches a vicinity of a central portion from the tip end portion along an axial center, is provided in the rod-like fixed electrode leading terminal 9, and an intersecting hole 9*b* is further provided, which is perpendicular to the shaft hole 9*a* and communicates with the shaft hole 9*a* in a radial direction. A communication path by the shaft hole 9*a* and the intersecting hole 9*b* allows communication between the back air chamber 8*b* formed in the insulating base 8 and a second air chamber 16 formed in the cup member 11 described below, and effectively functions as an acoustic mass (inertance).

Then, a low height cylindrical member 14 is screwed with the unit case 2 in the further rear of the ring member 12 that is screwed with the unit case 2, and a lid member 15 provided with an opening 15*a* in a central area is attached to the low height cylindrical member 14.

The fixed electrode leading terminal 9 enters the central opening 15*a* of the lid member 15, and the lid member 15 closes the cup member 11. The cup member 11 and the lid member 15 closing the cup member 11 form the above-described second air chamber 16. That is, the second air chamber 16 is an air chamber provided in the unit case 2, being separate from the back air chamber 8*b*.

A second acoustic resistor 18 formed into a toroidal shape is mounted to cover a vicinity of the intersecting hole 9*b* of the fixed electrode leading terminal 9. That is, the second acoustic resistor 18 is attached to the fixed electrode leading terminal 9 by insertion of the fixed electrode leading terminal 9 into a central hole of the second acoustic resistor 18. Then, the second acoustic resistor 18 is disposed in a sandwiched state between an adjustment ring 17 screwed with a male screw threaded on an outer peripheral surface of the fixed electrode leading terminal 9 and an end portion of the cylindrical portion 8*d* formed in the insulating base 8.

With this arrangement, the second acoustic resistor 18 lies between the back air chamber 8*b* and the second air chamber 16 through the communication path by the shaft hole 9*a* and the intersecting hole 9*b*. Then, the apparent density of the second acoustic resistor 18 can be adjusted according to the degree of screwing of the adjustment ring 17 with the fixed electrode leading terminal 9. Thus, adjustment of the second acoustic resistor 18 allows to adjust a non-directional component applied to the back air chamber 8*b* from the second air chamber 16.

In the condenser microphone unit 1 shown in FIG. 1, the communication path formed by the shaft hole 9*a* and the intersecting hole 9*b* that is provided in the fixed electrode leading terminal 9 made of metal functions as a pipe with an extremely small diameter, and acts as an acoustic mass, as described above.

Figure 5:
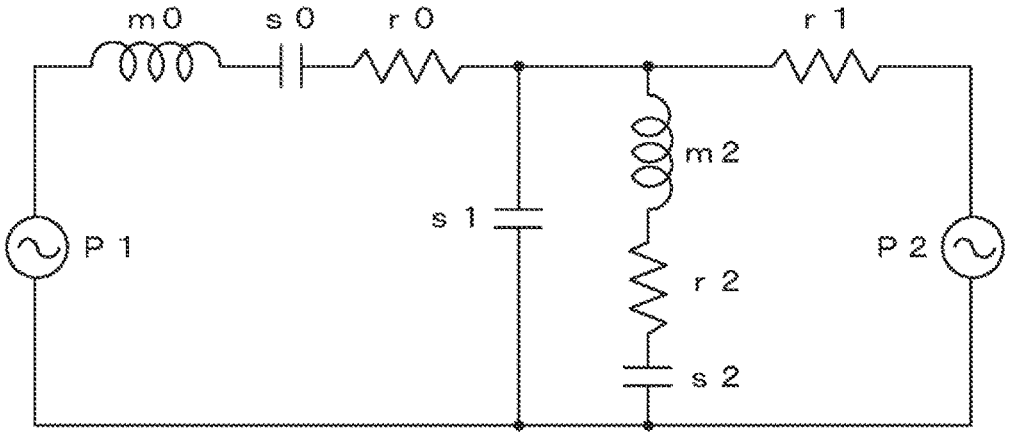
FIG. 5 is an acoustic equivalent circuit diagram of a condenser microphone unit according to the present invention.
Figure 9:
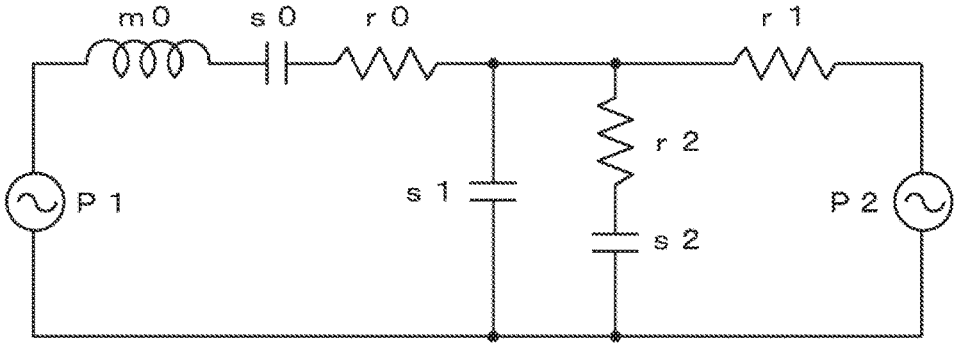
Fig. 9 Related Art
FIG. 9 is an acoustic equivalent circuit diagram of the condenser microphone unit illustrated in FIG. 8.

FIG. 5 shows an acoustic equivalent circuit of the condenser microphone unit 1 shown in FIG. 1, and this equivalent circuit shows a state in which an acoustic mass m2 formed by the shaft hole 9*a* and the intersecting hole 9*b* is added to the equivalent circuit shown in FIG. 9.

According to the equivalent circuit shown in FIG. 5, a low-cut filter composed of an equivalent coil L for the acoustic mass m2 and an equivalent capacitor C for the stiffness s2 of the second air chamber 16 is formed in the acoustic circuit.

With the configuration, a low-frequency component entering the second air chamber 16 through the acoustic mass m2 formed by the shaft hole 9*a* and the intersecting hole 9*b* is substantially moved to a lower frequency band. That is, since the non-directional component is moved to the lower-frequency band, the low-frequency directional component can be effectively compensated without affecting directivity in an audio band at about 1 kHz, for example.

Figure 7:
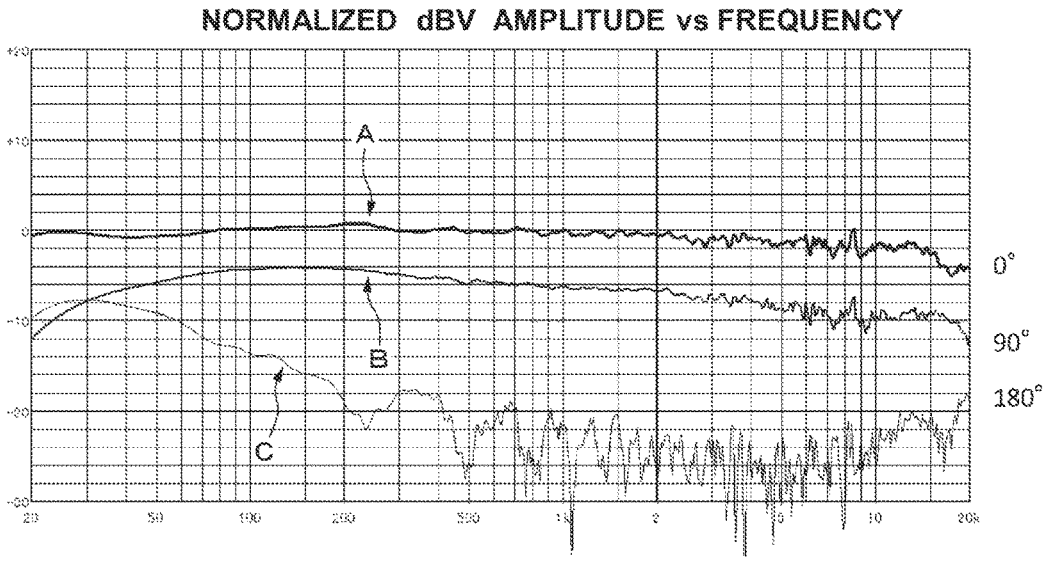
FIG. 7 is a graph illustrating frequency response characteristics of the condenser microphone unit illustrated in FIG. 1.
Figure 8:
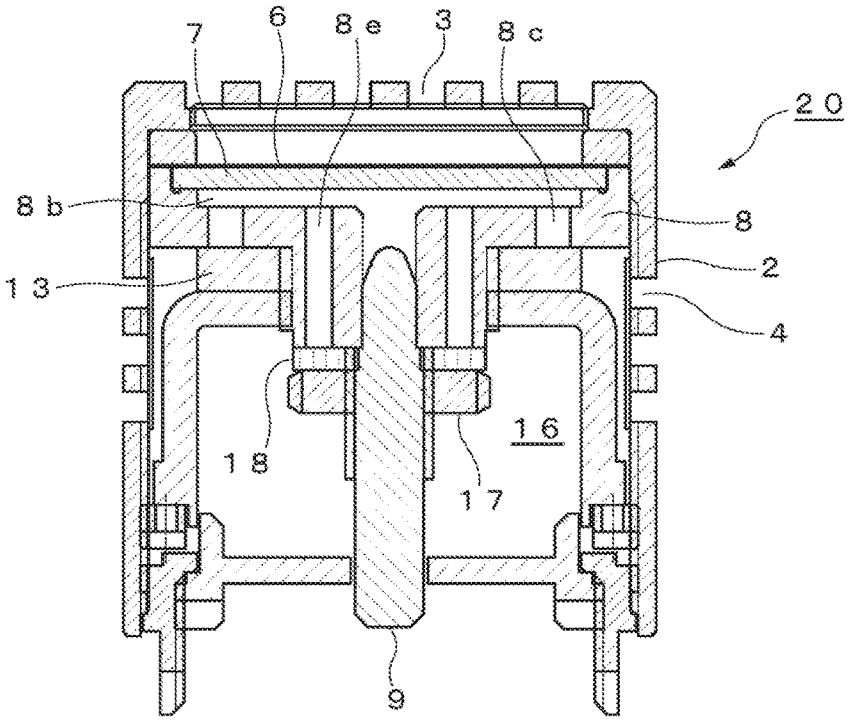
Fig. 8 Related Art
FIG. 8 is a central sectional view of a conventional condenser microphone unit.
Figure 10:
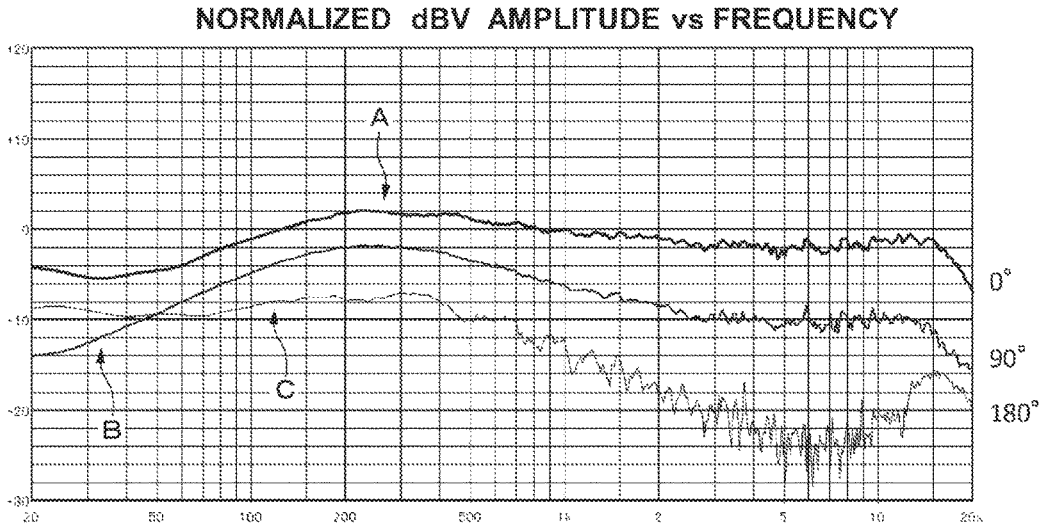
Fig. 10 Related Art
FIG. 10 is a graph illustrating frequency response characteristics of the condenser microphone unit illustrated in FIG. 8.
Figure 11:
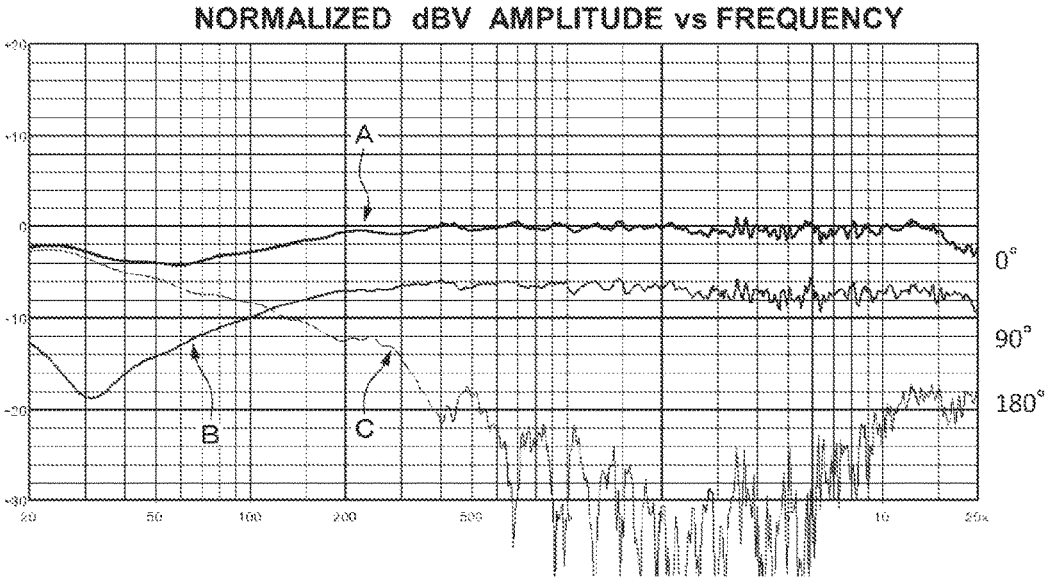
Fig. 11 Related Art
FIG. 11 is a graph illustrating frequency response characteristics of a typical condenser microphone unit.

The frequency response characteristics illustrated in FIG. 7 supports the effect, and characteristic curves A to C illustrate characteristics of respective angles with respect to a sound collecting axis being 0 degrees, 90 degrees, and 180 degrees, similarly to the graphs shown in FIGS. 10 and 11.

FIG. 7 illustrates the frequency response characteristics in a case where an opening diameter of the communication path (pipe) that functions as the acoustic mass m2 is set to 0.2 mm and its length is set to 3.5 mm, and the volume of the second air chamber 16 is set to 0.27 mL.

As shown in the measured values in FIG. 7, the second air chamber 16 can improve the low-frequency response with the volume kept small, as shown in FIG. 1.

Since the volume of the second air chamber 16 can be designed to be small, a condenser microphone unit can be achieved which is small in size and has an improved low-frequency response and in which the proximity effect is reduced.

Figure 2:
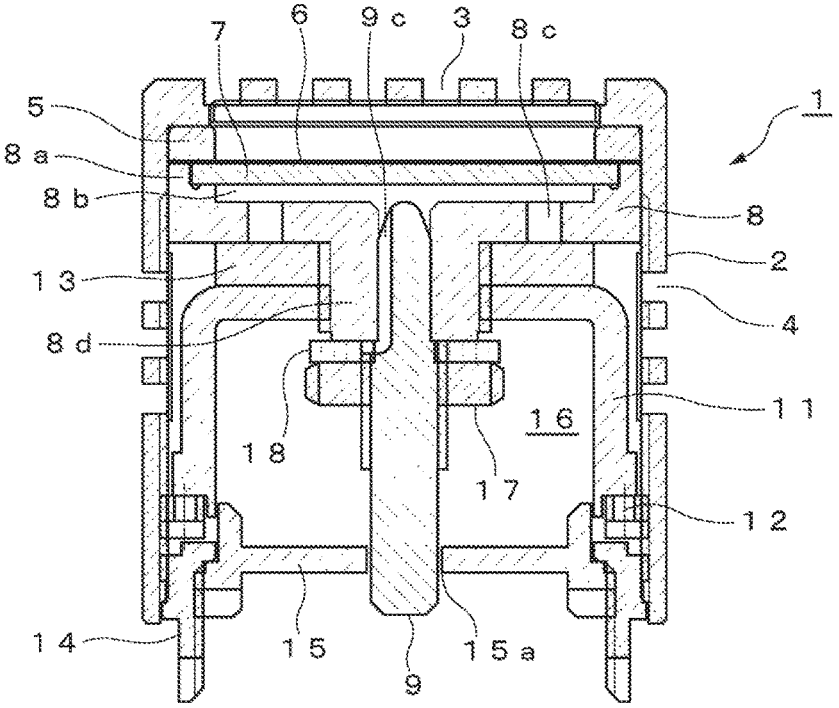
FIG. 2 is a central sectional view illustrating a second embodiment.

FIG. 2 illustrates a second embodiment of a unidirectional condenser microphone according to the present invention. In the second embodiment, a groove hole 9*c* that reaches a vicinity of a central portion from a tip end portion is provided on a side surface of a rod-like fixed electrode leading terminal 9. Other configurations are not changed from the configurations of the first embodiment shown in FIG. 1, and corresponding portions are denoted with the same reference signs and its detailed description is omitted.

According to the second embodiment, a formed portion of the groove hole 9*c* in the fixed electrode leading terminal 9 is fitted and fixed to a cylindrical portion 8*d* that is integrally formed in the insulating base 8, and thus the groove hole 9*c* constitutes a communication hole with a small diameter between the groove hole 9*c* and the cylindrical portion 8*d*. This communication hole with a small diameter functions as the above-described acoustic mass m2, and an acoustic equivalent circuit similar to the example illustrated in FIG. 5 is formed.

The second embodiment shown in FIG. 2 can allow to obtain functions and effects similar to the first embodiment shown in FIG. 1.

Figure 3:
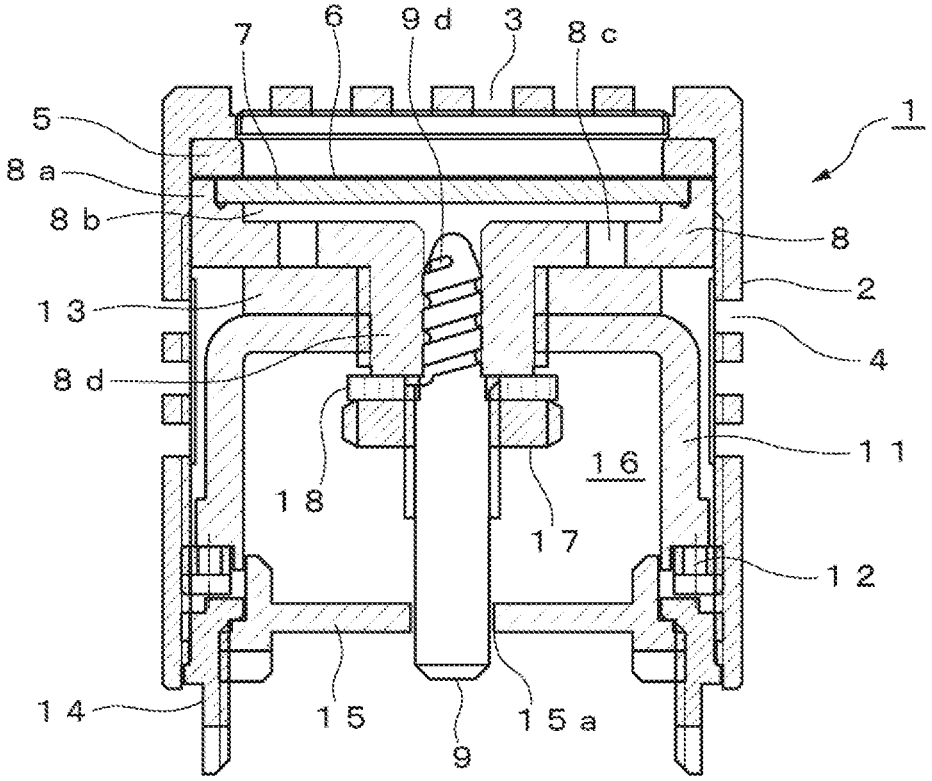
FIG. 3 is a central sectional view illustrating a third embodiment.

FIG. 3 illustrates a third embodiment of a unidirectional condenser microphone according to the present invention. In the third embodiment, a spiral groove hole 9*d* is provided on a columnar surface of a rod-like fixed electrode leading terminal 9 to reach a vicinity of a central portion from a tip end portion. Note that other configurations are not changed from the configurations of the first embodiment illustrated in FIG. 1, and corresponding portions are denoted with the same reference signs and its detailed description is omitted.

According to the third embodiment, a portion to which the spiral groove hole 9*d* is formed of the fixed electrode leading terminal 9 is fitted and fixed to a cylindrical portion 8*d* integrally formed in the insulating base 8, and thus the spiral groove hole 9*d* constitutes a communication hole with a small diameter between the spiral groove hole 9*d* and the cylindrical portion 8*d*. This communication hole with a small diameter functions as the above-described acoustic mass m2, and an acoustic equivalent circuit similar to the example shown in FIG. 5 is formed.

According to the third embodiment, with the spiral groove hole 9*d* provided on a columnar surface of the fixed electrode leading terminal 9, the longer communication hole with a small diameter can be formed. With the configuration, the acoustic mass m2 having a larger value is added to the equivalent circuit shown in FIG. 5.

Correspondingly, the value of the equivalent coil L obtained for the acoustic mass m2 is increased, which contributes to more remarkably improve low-frequency characteristics.

FIGS. 4A to 4E schematically illustrate configuration examples of a shaft hole or a groove hole provided in a fixed electrode leading terminal 9, and these configuration examples are illustrated in a state where the fixed electrode leading terminal 9 is viewed from its tip end portion.

Figure 4A:
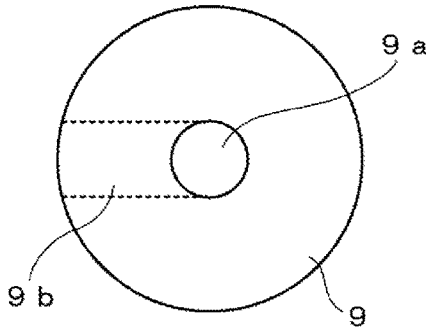
FIGS. 4A to 4E are schematic diagrams illustrating favorable embodiments of a communication path provided in a fixed electrode leading terminal.

FIG. 4A illustrates an example in which a shaft hole 9*a* along an axial center of the fixed electrode leading terminal 9 and an intersecting hole 9*b* that is perpendicular to the shaft hole 9*a* and communicating with the shaft hole 9*a* in a radial direction are provided. This configuration has been employed in the first embodiment shown in FIG. 1.

Figure 4B:
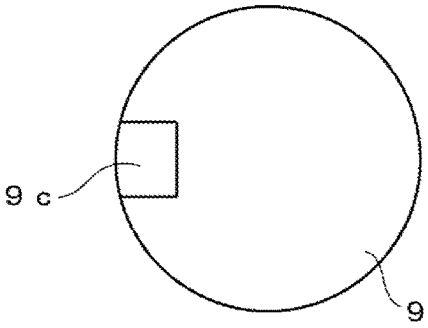

FIG. 4B illustrates an example in which a groove hole 9*c* is provided on a side surface of the fixed electrode leading terminal 9 along an axial direction. This configuration has been employed in the second embodiment shown in FIG. 2.

Figure 4C:
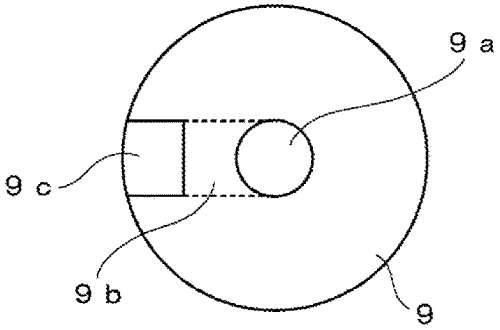

FIG. 4C illustrates an example in which the shaft hole 9*a* and the intersecting hole 9*b* both shown in FIG. 4A and the groove hole 9*c* shown in FIG. 4B are further provided in the fixed electrode leading terminal 9. According to this example, an acoustic mass m2*a* due to the shaft hole and an acoustic mass m2*b* due to the groove hole are disposed in parallel.

Figure 6:
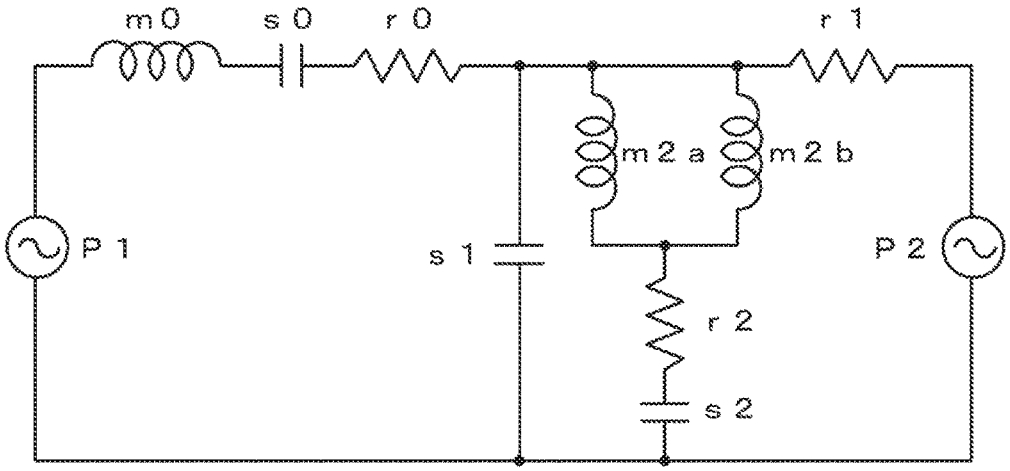
FIG. 6 is an acoustic equivalent circuit diagram of a condenser microphone unit of another embodiment according to the present invention.

Its acoustic equivalent circuit, therefore, becomes to one where have an equivalent coil L for the acoustic mass m2*a* and the acoustic mass m2*b* is connected in parallel, as shown in FIG. 6.

Figure 4D:
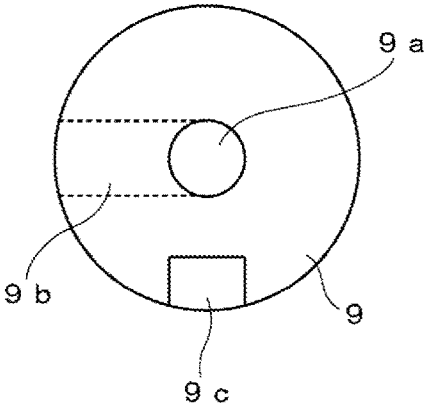

FIG. 4D illustrates a case where the position at which the groove hole 9*c* to be provided is shifted by 90 degrees in the peripheral direction from the position in the configuration shown in FIG. 4C, and its acoustic equivalent circuit is nearly similar to the example shown in FIG. 6.

Figure 4E:
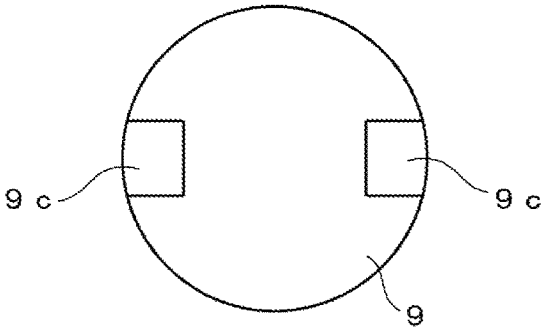

Further, FIG. 4E illustrates an example in which the groove holes 9*c* are respectively provided on opposing side surfaces (side surfaces opposing at 180 degrees) of the fixed electrode leading terminal 9, and its acoustic equivalent circuit is nearly similar to the example of FIG. 6.

The above described unidirectional condenser microphone unit according to the present invention allows to achieve a configuration in which the acoustic mass (inertance) between the back air chamber and the second air chamber is disposed by forming the communication path with a small diameter utilizing the fixed electrode leading terminal, made of metal, which leads the signal voltage generated at the fixed electrode.

A low-pass filter formed of the acoustic mass and stiffness of the second air chamber can lower its cutoff frequency. As a result, a condenser microphone unit with improved low-frequency response without affecting intermediate-frequency response can be provided, which is as described above, as functions and effects of the present invention.

The unidirectional condenser microphone according to the present invention is configured to enable to vary each of the bulk density of the first acoustic resistor and the second acoustic resistor. This configuration allows to independently adjust the bidirectional component and the unidirectional component both of which are applied to the back air chamber.

What is claimed is:

1. A unidirectional condenser microphone unit, comprising:

a unit case including:

a diaphragm that vibrates upon receiving a sound wave;

a fixed electrode disposed to face the diaphragm;

an insulating base that supports the fixed electrode to form a back air chamber between the insulating base and the fixed electrode; and a fixed electrode leading terminal made of metal that is attached to the insulating base, and that leads a signal voltage generated at the fixed electrode, wherein the unit case is provided with a front acoustic terminal hole formed in a front side of the diaphragm and a rear acoustic terminal hole for communication with the back air chamber, wherein the unit case is provided with a second air chamber different from the back air chamber and the fixed electrode leading terminal is provided with a communication path for communicating between the back air chamber and the second air chamber.

2. The unidirectional condenser microphone unit according to claim 1, wherein the fixed electrode leading terminal is formed into a pillar shape, and is provided with a shaft hole or a groove hole along an axial direction of the pillar shape, and the shaft hole or the groove hole which constitutes the communication path between the back air chamber and the second air chamber.

3. The unidirectional condenser microphone unit according to claim 1, wherein the fixed electrode leading terminal is formed into a columnar shape, and is provided with a spiral groove hole along a columnar surface, and the spiral groove hole constitutes the communication path between the back air chamber and the second air chamber.

4. The unidirectional condenser microphone unit according to claim 1, wherein the fixed electrode leading terminal is provided with plural communication paths between the back air chamber and the second air chamber in.

5. The unidirectional condenser microphone unit according to claim 1, wherein a first acoustic resistor is disposed between the back air chamber and the rear acoustic terminal hole.

6. The unidirectional condenser microphone unit according to claim 1, wherein a second acoustic resistor is disposed between the back air chamber and the second air chamber.

7. The unidirectional condenser microphone unit according to claim 6, wherein the second acoustic resistor is formed into a toroidal shape and is attached to the fixed electrode leading terminal by insertion of the fixed electrode leading terminal into a central hole, and the second acoustic resistor is formed between an adjustment ring screwed with the fixed electrode leading terminal and the insulating base to make an acoustic resistance value of the second acoustic resistor variable.

8. The unidirectional condenser microphone unit according to claim 1, wherein the second air chamber is opposing to the back air chamber with the insulating base therebetween and is disposed in the side of the fixed electrode leading terminal.

* * * * *